US010775008B2

(12) United States Patent
Dalby et al.

(10) Patent No.: US 10,775,008 B2
(45) Date of Patent: Sep. 15, 2020

(54) LIGHTING DEVICE

(71) Applicant: TRIDONIC GMBH & CO KG, Dornbirn (AT)

(72) Inventors: Paul Dalby, Middlesbrough (GB); Graeme Jones, Newton Aycliffe (GB); John Kears, Witton Gilbert (GB); Stephen Parkes, Darlington (GB); Ian Wilson, East Herrington, Sunderland (GB); John Richardson, Spennymoor (GB)

(73) Assignee: TRIDONIC GMBH & CO KG, Dornbirn (AT)

( * ) Notice: Subject to any disclaimer, the term of this patent is extended or adjusted under 35 U.S.C. 154(b) by 0 days.

(21) Appl. No.: 16/340,710

(22) PCT Filed: Sep. 27, 2017

(86) PCT No.: PCT/EP2017/074484

§ 371 (c)(1),
(2) Date: Apr. 10, 2019

(87) PCT Pub. No.: WO2018/077560

PCT Pub. Date: May 3, 2018

(65) Prior Publication Data

US 2019/0316745 A1 Oct. 17, 2019

(30) Foreign Application Priority Data

Oct. 28, 2016 (EP) ..... 16196198
Apr. 13, 2017 (GB) ..... 1706154.0

(51) Int. Cl.
*F21S 9/02* (2006.01)
*F21S 8/02* (2006.01)
(Continued)

(52) U.S. Cl.
CPC ..... *F21S 9/022* (2013.01); *F21S 8/026* (2013.01); *F21V 15/01* (2013.01); *F21V 17/164* (2013.01);
(Continued)

(58) Field of Classification Search
CPC ..... F21S 9/022; F21S 8/026; F21V 15/01; F21V 17/164; F21V 21/046; F21V 23/001; F21V 23/023
See application file for complete search history.

(56) References Cited

U.S. PATENT DOCUMENTS

2003/0016532 A1 1/2003 Reed
2006/0072306 A1 4/2006 Woodyard
2009/0244880 A1 10/2009 Rapeanu et al.

FOREIGN PATENT DOCUMENTS

EP 1 650 487 4/2006
GB 2543558 4/2017
(Continued)

OTHER PUBLICATIONS

European search report in co-pending European patent application 16196198 dated Jan. 17, 2017.
(Continued)

*Primary Examiner* — Thomas M Sember
(74) *Attorney, Agent, or Firm* — Andrus Intellectual Property Law

(57) ABSTRACT

The invention proposes a lighting device, in particular an emergency lighting device. The lighting device includes a first housing (2), a lighting means (12), for example an LED arranged at the first housing (2) and an electronic circuitry accommodated in the first housing (2) for operating the lighting means (12). A second housing (3) of the lighting device accommodates an energy storage means (13) such as a rechargeable battery, wherein the first housing (2) and the
(Continued)

second housing (3) are arranged spaced apart. An interconnecting means (4) mechanically connects the first housing (2) and the second housing (3) in an elastic manner and also connects electrically the electronic circuitry and the energy storage means (13). The interconnecting means (4) of the lighting device of a preferred embodiment comprises a cable which is overmoulded to provide compressive strength in an axial direction of the cable.

16 Claims, 8 Drawing Sheets

(51) Int. Cl.

| | |
|---|---|
| ***F21V 15/01*** | (2006.01) |
| ***F21V 17/16*** | (2006.01) |
| ***F21V 21/04*** | (2006.01) |
| ***F21V 23/00*** | (2015.01) |
| ***F21V 23/02*** | (2006.01) |
| *F21Y 115/10* | (2016.01) |

(52) U.S. Cl.
CPC ..... *F21V 21/046* (2013.01); *F21V 23/001* (2013.01); *F21V 23/023* (2013.01); *F21Y 2115/10* (2016.08)

(56) References Cited

FOREIGN PATENT DOCUMENTS

| | | |
|---|---|---|
| GB | 2543664 | 4/2017 |
| JP | 2013045704 | 3/2013 |

OTHER PUBLICATIONS

Great Britain search report in co-pending Great Britain patent application 1706154.0 dated Oct. 11, 2017.
PCT search report in parent PCT application PCT/EP2017/074484 dated Nov. 15, 2017.
European opinion in co-pending European patent application 16196198 dated Nov. 28, 2018.

LIGHTING DEVICE

CROSS REFERENCE TO RELATED APPLICATIONS

The present application is the U.S. national stage application of International Application PCT/EP2017/074484 filed Sep. 27, 2017, which International Application was published on May 3, 2018 as WO 2018/077560 A1. The International Application claims priority to European Application 16196198.2 filed Oct. 28, 2016 and Great Britain Application 1706154.0 filed Apr. 13, 2017.

FIELD OF THE INVENTION

The invention is in the field of luminaires and in particular in the field of emergency lighting devices. A lighting device housing arrangement, in particular for an emergency lighting device using an external power supply and including additional internal energy storage and particularly suited for arranging in confined spaces, for example for mounting in detached ceilings, is proposed.

BACKGROUND OF THE INVENTION

Lighting devices in the form of recessed luminaires, for example for mounting in false (detached) ceilings are widely used. Applications for such recessed luminaires are emergency lighting devices (luminaires) which are designed for continuing operation under circumstances of mains supply failure, in case of a mains failure or of a general failure of the driving voltage, the lighting means of an emergency lighting device are intended to emit at least a basic light, in order to enable a person to orient in a lighted area in a building, and to ensure that the person can safely leave the building. In case of power supply failure, power supply for driving the light emitting means, typically including one or more light emitting diodes (LED) of an emergency lighting device is performed by emergency power supply in form of a battery or rechargeable battery. The battery for an emergency lighting device can be part of dedicated emergency converter or of a normal converter for driving the lighting means. Depending on a current operating status, the converter uses either an externally supplied power supply voltage (standard operating mode) or a voltage provided by the emergency power supply means (emergency operating mode) to generate an operating voltage for the light emitting means. The capability of operating in an emergency operating mode does however require further elements such as a battery, charging circuitry for charging the battery to be provided at the emergency lighting device. In case of a recessed luminary the space requirements for arranging and for mounting the recessed luminary increase accordingly.

DE 100 44 695 A1 discloses a remotely operated light controller whose physical layout is specifically designed for mounting the remotely operated light controller behind wall panels. The remotely operated light controller circuitry is grouped into functional units and each functional unit is arranged encapsulated in a small, preferably flat cylindrical housing. The functional units in the housing are linked via cables into a chain and thus can be inserted one by one into the limited space available between the solid wall and the wall panels usually mounted on a laths arrangement to the solid wall via a hole in the wall panel. One functional unit after the other is inserted and then lowered by their own weight hanging on the flexible cables linking the functional units. The hole is subsequently closed by a lid or by mounting a luminary controlled by the remotely operated light controller.

The remotely operated lighting controller provides a solution for the confined spaces behind wall panels, but requires extensive cabling efforts, assembling of plugs to cables and relies on gravitational force during wall mounting. The handling of the plurality of flexibly connected parts is cumbersome.

SUMMARY OF THE INVENTION

The invention addresses the technical problem of improving the known lighting devices for use in a confined space while reducing manufacturing and mounting complexity so that overload installation is easily possible.

The problem is solved by a lighting device comprising a first housing, a lighting means arranged at the first housing, an electronic circuitry accommodated in the first housing for operating the lighting means and a second housing accommodating an energy storage means, wherein the first housing and the second housing are arranged in a spaced apart manner using an interconnecting means adapted to connect the first housing and the second housing elastically and simultaneously to connect the electronic circuitry and the energy storage means electrically.

The electronic circuitry is arranged in the first housing and the energy storage means, for example a battery or accumulator, in the second housing. Due to the first housing and the second housing being separate housings and being arranged spaced apart, thermal heat emitted by the lossy electronic circuitry, for example including driving means for the lighting means, a charging means for charging the energy storage means and a mains interface means for interfacing a mains supply, does not adversely effect the energy storage means which usually is sensitive to heat.

The interconnecting means is adapted to provide pivotal (swivelling) mechanical connection between the first and second housing and an electrical connection between charging means and electrical storage means. The pivot axis is in particular essentially perpendicular to a common center line of the first housing and the second housing when the first and second housing are brought in an aligned position. The common center line of the first and second housing typically corresponds to a main insertion direction of the lighting device into a mounting opening in a detached ceiling or wall panels.

The pivotal (rotatable, swivelling) mechanical connection between the first housing and the second housing improves or even enables access to small spaces for the inventive lighting device even only accessible via a pushing insertion movement, whereas the known lighting devices provide only limited or even no capability to transmit compressive forces between modules of the lighting device.

In the lighting device according to an advantageous embodiment, the interconnecting means is formed as a hinge is formed as a hinge adapted to rotatably connect the first housing and the second housing. The hinge provides at least one axis of rotation, particularly one axis of rotation around which the first housing and the second housing can be bent or folded relative to each other. In this embodiment it is preferred that the hinge is made from rigid material and the interconnecting means is designed to accommodate the electrical connection. The hinge may be formed with a groove for example in which a cable is inserted.

In a preferred alternative lighting device the interconnecting means is adapted to connect the first housing and the second housing elastically. I.e. the material and the design of the interconnecting means are deformed such that the interconnecting means can be deformed such that the first and second housing can be bent or folded about an axis preferably perpendicular to the common axis of the first and second housing.

The interconnecting means of this preferred embodiment is adapted to integrally provide elastic mechanical connection between the first and second housing and simultaneously an electrical connection between charging means and electrical storage means. Thus, a single element provides electric as well as mechanic functions for the emergency lighting device, thereby reducing number of structural elements with advantageous effects for manufacturing and assembly. The elasticity of the interconnection means is chosen such that the combination of the first housing and the second housing can be handled as one device. Thus, the second housing accommodating the accumulator can easily be introduced into a recess of a detached ceiling by manipulating the first housing only. After being inserted the elasticity allows that the relative position of the first and second housing with respect to each other changes. This allows to use small gaps between the solid ceiling and the detached ceiling.

Preferably, the lighting device includes the interconnecting means comprising a cable which is over-moulded to provide compressive strength in an axial direction of the cable which at the same time providing elasticity in a traverse direction.

The interconnecting means is adapted to mechanically connect first and second housings and is itself elastic. The interconnecting means being elastic means that it is suited to transmit compressive force contrary to a flexible cable of prior art which only transmits tensile force. Hence, the mounting of the lighting means into the space behind a detached ceiling through a small opening in the detached ceiling is easier to perform than in case of the known separate functional units only linked via flexible cables.

The interconnection means being advantageously formed via encapsulating an electric connecting cable, for example injection moulding, extrusion coating, or else, provides an interconnection means combining elasticity with the necessary electrical connectivity at comparative manufacturing costs in particular as standard cables can be used. The lighting device is accordingly well adapted to being manufactured in large numbers.

The emergency lighting device according to an advantageous embodiment has the interconnecting means showing a cross section with a first width (thickness) in the first direction being smaller than a second width in a second direction orthogonal to the first direction. Both dimensions are small compared to the longitudinal extension of the connecting means.

Designing the cross section in this manner, for example with an approximately rectangular cross section, ensures a bending of the interconnection means in a preferential direction, the preferential direction given by the direction with the smaller width of the cross section.

Preferably, in an emergency lighting device according to an embodiment the interconnecting means comprises a first straight portion, a second straight portion and a pre-bended portion between the first straight portion and the second straight portion.

The bended portion ensures a middle axis of the first housing to correspond to a middle axis of the second housing (in particular in case of basically cylindrical shape of the housings) when the second housing has a slightly smaller width (diameter) than the first housing. Thus insertion of the lighting means through a hole with a small diameter being almost equal to the first housing width is easy to accomplish.

Preferably, the emergency lighting device includes at least one of the first housing and the second housing providing guiding means adapted to a preferred bending direction for the interconnecting means when the interconnecting means is bended.

By predefining an advantageous bending direction the guiding means ensures that neither the second housing interferes with a power supply cable when mounted into a small space, nor that the distance between the first housing and the second housing becomes to small. Thus, even in an installed position a minimum thermal isolation between the electronic circuitry in the first housing and the energy storage means in the second housing can be ensured by a minimum distance between the first housing and the second housing. The guiding means can also be suitably formed in order to maintain a prescribed minimum bending radius for the electrical cable in the interconnecting means.

The emergency lighting device according to a preferred embodiment is characterized in that the interconnecting means includes a first connector for electrically connecting the interconnecting means to a printed circuit board arranged in the first housing.

Preferably the emergency lighting device arranges the electronic circuitry on the printed circuit board and on at least one further electric circuit board, and the printed circuit board and the at least one further electric circuit board are connected by a flexible cable. As an alternative the emergency lighting device the electronic circuitry is arranged on the printed circuit board and at least one further electric circuit board, and the printed circuit board and the at least one further electric circuit board are rigid parts of a joint flexible circuit board.

The first printed circuit board and the second printed circuit board being arranged in the first housing include the electronic circuitry for interfacing the mains supply, the circuitry for a charging means for charging the energy storage means and circuitry for a driving means driving the lighting means, for example an LED converter.

Multiple circuit boards in the first housing ensure a best possible use of the limited available space in the first housing and accordingly the electronic circuitry is arranged separately from the second housing encapsulating the energy storage means, while the first and second housing are detachably electrically connected.

An advantageous embodiment of the emergency lighting device includes the lighting means adapted to detachably connect via a connector to at least one of the printed circuit board and the at least one further printed circuit board.

The lighting means being detachable provides the advantage of easily adapting the lighting device from spotlight to emergency light or to escape route pointing by simply exchanging the lighting means as an entire module with a module which incorporates the desired light emitting characteristic by having appropriate optics arranged in a light path. The electronic circuitry arranged in the first housing and the energy storage means arranged in the second housing can remain unchanged when adapting the light emitting characteristic by exchanging the lighting means, for example an LED module including the optics.

Preferably, the emergency lighting device shows the interconnecting means comprising a second connector, for electrically connecting the interconnecting means to the energy storage means.

The energy storage means can therefore be replaced easily when reaching an end of its life expectation or when the energy storage capacity needs to be adapted to changing requirements for the emergency lighting device.

According to an advantageous embodiment of the (emergency) lighting device, a charging means for charging the energy storage means and forming part of the electronic circuitry is adapted to detect a type of the energy storage means.

The exchange of the energy storage means is further facilitated when the electronic circuitry is adapted to recognize the type of electronic storage means being electrically connected and adapts its characteristics, for example a charging current accordingly without requiring additional amendments to the electronic circuitry.

A further preferred emergency lighting device according to an embodiment has the second housing including a first end portion opposite to a second end portion arranged towards the first housing, the first end portion being formed to achieve a preferred bending direction of the interconnecting means.

The emergency lighting device according to an embodiment has the interconnecting means including locking means adapted to cooperate with corresponding engaging means on the housing side for securing the interconnecting means of the second housing for example. In that case the interconnecting means is fixedly attached to the first housing and detachably attached to the second housing. Of course, it could be realized vice versa.

The emergency lighting device may comprise the lighting means designed to hold a interchangeable optics, preferably interchangeable lens.

The emergency lighting device may comprise at least two recess areas and at least two fixing means. The fixing means may each comprise a spring coil and a spring arm. The fixing means may be mounted in the recess area.

The recess area may comprise a protuberance on one end and holding means with a hole on the other end whereby the spring coil may be designed to be pushed into the recess area and onto the protuberance and the tail of the spring arm may be designed for insertion through the hole.

BRIEF DESCRIPTION OF THE DRAWINGS

The invention will be described in more detail in preferred embodiments with reference to the attached figures, in which.

DETAILED DESCRIPTION

Figure 1:
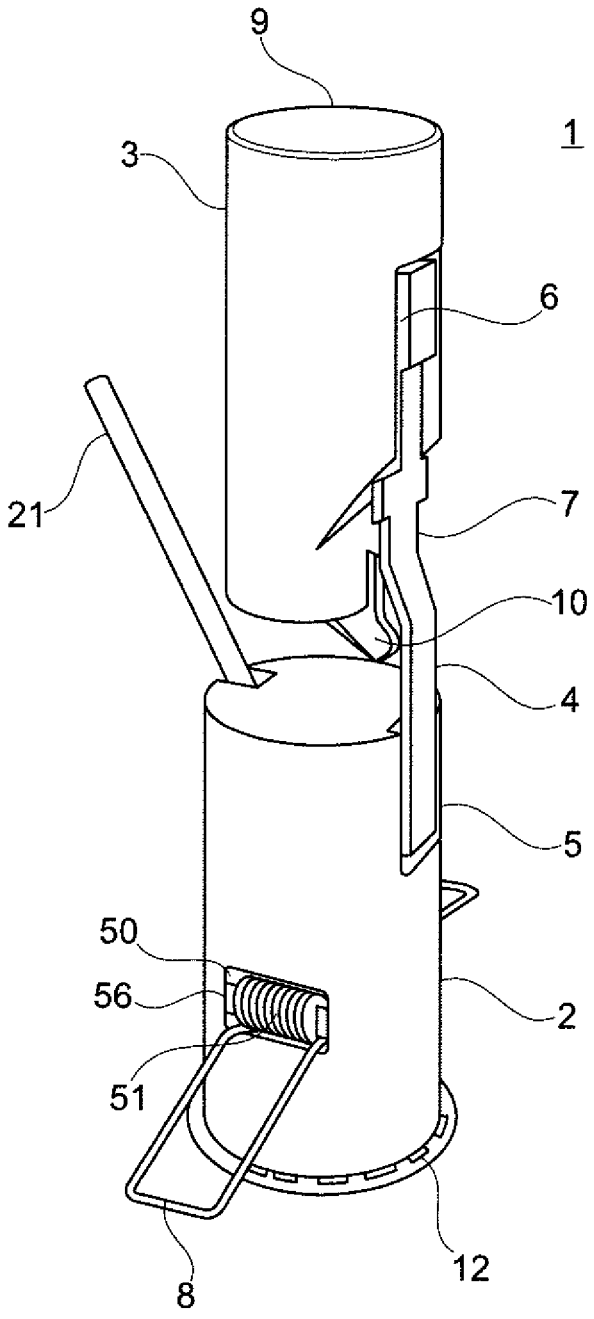
FIG. 1 shows a perspective view of an assembled emergency lighting device of a preferred embodiment.

Throughout the attached figures, same reference numerals denote the same elements. In the description of different figures, the description of elements denoted by the same reference signs is not necessarily repeated for sake of conciseness.

In the following description of embodiments an emergency lighting device 1 as an example is discussed. The invention is, nevertheless not restricted to an emergency lighting device 1, but may be applied to any lighting device including an energy storage means.

FIG. 1 shows a perspective view of an assembled emergency lighting device 1 of a preferred embodiment.

The emergency lighting device 1 comprises a first housing 2 and a second housing 3 which are detachably connected to each other by an interconnecting means 4. The interconnecting means 4 connects the first housing 2 and the second housing 3 in spaced apart manner, so that between the first housing 2 and the second housing 3 are predetermined distance is ensured.

The interconnecting means 4 is essentially a cable including two or more electrically conducting connecting lines in an isolating mantle and being further encapsulated by overmolding. The interconnecting means 4 incorporates a strain relief which is encapsulated by the first housing 2 when being assembled. The interconnecting means 4 of the preferred embodiment also comprises a click-in strain relief for engaging the second housing 3 in order to prevent the interconnecting means 4 being pulled out when the emergency lighting means 1 is removed from a mounting opening in a detached ceiling 32.

According to the embodiment shown in FIG. 1, the interconnecting means 4 includes a first straight portion 5, a pre-bended portion 7 and a second straight portion 6, the first straight portion 5 arranged towards the first housing 2 and including a first connector for interfacing the electronic circuitry arranged in the first housing 2. The pre-bended portion 7 is between the first straight portion 5 and the second straight portion 6 and produces an offset of the first and second straight portion. The second straight portion 6 is arranged towards the second housing 3. The second straight portion 7 includes a second connector preferably of a standardized type, for example a mini-USB-connector or a micro-USB-connector for interfacing an energy storage means 13 accommodated in the second housing. The pre-bended portion 7 includes a first bended portion bending from an axis of the first straight portion 5 to a first direction with a predetermined angle, and a second bended portion bending with the predetermined angle to back to the axis of the first straight portion 5. The axis of the first straight portion 5 is parallel to a second axis of the second straight portion 6. Thus the second housing 3 which has a smaller width than the first housing 2 is arranged along a central axis of the first housing 2 in a normal, unbent position of the elastic interconnecting means 4.

At least the second straight portion 6 of the interconnecting means 4 can include locking means in order to engage the interconnecting means 4 with a corresponding locking means arranged at the side face of the second housing 3. The interconnecting means 4 can also include a release mechanism for releasing the locking means in order to detach the interconnecting means 4 from the second housing 3. The connection on the first housing side can be realized in the same way or un-detachably.

The second housing 3 also comprises guiding means 10 which guides the interconnecting means 4 into a preferred bending direction when during insertion of the emergency lighting device 1 into the limited space above a detached ceiling 32, a resistance is encountered. For example, the uppermost part of the second housing 3 with its upper first portion 9 reaches a ceiling 31 during inserting the emergency lighting device 1 through a mounting opening in the detached ceiling 32.

The upper side 9 can have a specific shape in order to further support bending the interconnecting means 4, for example comprising rounded edges or an inclined surface along a circumferential portion of the upper side 9. The upper side 9 of the second housing thus can be suitably sloped in order to further support relative bending of the interconnecting means 4 into a predetermined direction.

A guiding means 10 situated at the second housing 3 forces the interconnection means 4 to bend in a direction away from the mains supply cable 21, when mounting the emergency lighting device 1 in a confined space and is discussed with reference to FIG. 5*a*.

The first housing 2 comprises lighting means 12 which is preferably formed as a LED head. The first housing 2 further comprises fixing means 8 comprising a spring coil 51 for mounting the emergency lighting device 1 as a recessed luminaire. The first housing 2 comprises at least two recess areas 50. The fixing means 8 is mounted in the recess area 50. The recess area may comprise at least one protuberance 56 on one end. The spring coil 51 of fixing means 8 may be mounted on the protuberance 56.

Figure 2:
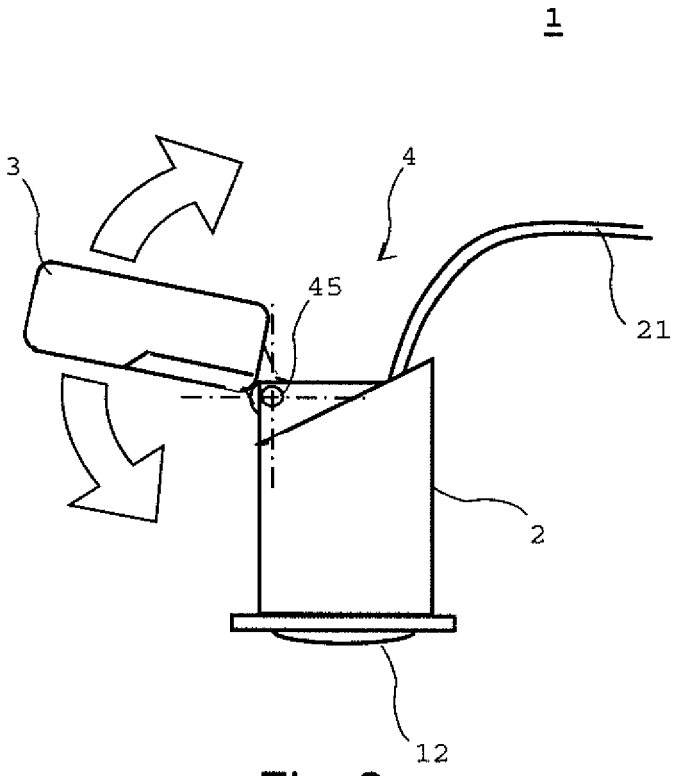
FIG. 2 shows a perspective view of an assembled emergency lighting device of a further embodiment, FIG. 3 provides a perspective view of a partial sectional view of a preferred embodiment, FIG. 4 provides a view of a partial sectional view of a preferred embodiment showing attachment details of the interconnecting means.

FIG. 2 shows a perspective view of an assembled emergency lighting device 1 of a further embodiment. The emergency lighting means 1 shown in FIG. 2 comprises the interconnecting means 4 to implement a pivotal mechanical connection between the first housing 2 and the second housing 3. The interconnecting means 4 of FIG. 2 comprises rigid elements on both the first housing' side and the second housing's side. These elements are connected to each other for example by a shaft to form a hinge 45 with a single fixed axis of rotation. The hinge 45 enables the first housing 2 and the second housing 3 to rotate relative to each other around fixed axis of rotation perpendicular to the image plane of FIG. 2. The rotation axis is perpendicular to respective center axis of the first housing 2 and the second housing 3. The first and the second housing 2, 3 may thus be aligned with each other or bent relative to each other. Thus, the same relative movement as in the first embodiment may be realized.

An electrical connection between the printed circuit board 39 in the first housing 2 and the energy storage means 13 in the second housing 3 may be established either by means of a rotary joint forming part of the hinge 45 or by means of flexible electrical cable not visible in FIG. 2. Preferably, the electrical cable connecting the printed circuit board 39 in the first housing 2 and the energy storage means 13 in the second housing 3 is guided between a first hinge part and a second hinge part forming the hinge 45. Thus, leaf portions of the first and second hinge protect the electrical cable which is arranged between the first hinge and the second hinge mechanically.

Figure 3:
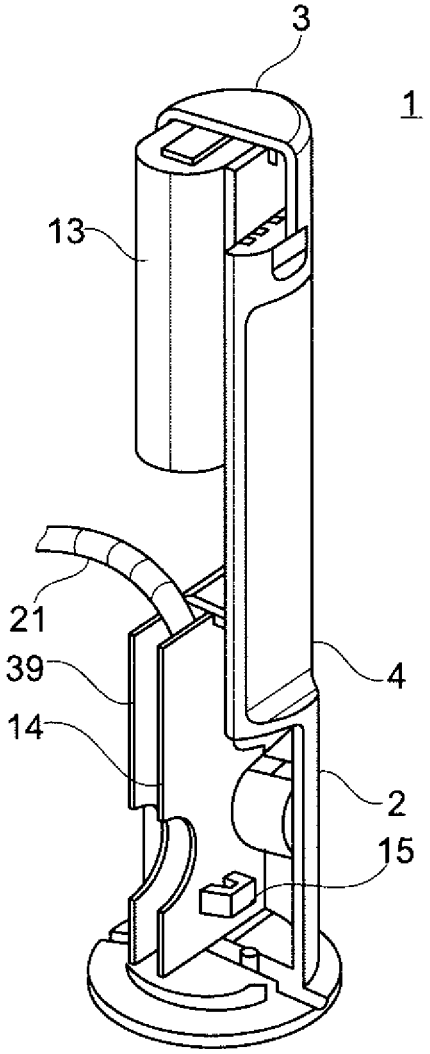

FIG. 3 provides a perspective view of a partial sectional view of a preferred embodiment. In FIG. 3, the interconnecting means 4 is of slightly different, straight shape. However, the basic configuration of the interconnecting means 4 is of the same form, being essentially a cable including two or more electrically conducting connecting lines in an isolating mantle and being further encapsulated by over-moulding in order to achieve elasticity of the interconnecting means. The elasticity preferably is chosen such that even in a horizontal orientation of the lighting device the interconnecting means does not bend because of the weight of the second housing accommodating the accumulator. Only when a mechanical resistance adds a bending force during mounting the lighting device, the interconnecting means will bend.

The interconnecting means 4 includes a first connector, for example a micro-USB connector, for connecting to the electronic circuitry in the first housing 2. A strain relief is moulded in the interconnection means 4 and is captured by the housing enclosure of the first housing 2. The interconnecting means 4 includes a further, second connector for connecting to the energy storage means 13, for example via micro-USB connector, at the end of the interconnecting means 4 facing the second housing 3 in an assembled state of the emergency lighting means 1.

In FIG. 3 a first printed circuit board 39 and a second printed circuit board 14 being arranged in parallel in the first housing 2 are shown. On the first printed circuit board 39 and the second printed circuit board 14, the electronic circuitry for a charging means for interfacing the mains supply, the circuitry for a charging means for charging the energy storage means and circuitry for a driving means driving the lighting means, for example an LED converter, are arranged. The second electronic circuit board 14 further includes a connector plug 14 for receiving the first connector of the interconnecting means 4, the first connector of the interconnecting means 4 is however not shown in FIG. 3. The printed circuit board 39 can include means for mechanically and electrically interfacing the lighting means 12 discussed below with reference to FIG. 6 in more detail.

Preferably are the first printed circuit board 39 and the second printed circuit board 14 formed as two parts of one joint flexible circuit board. In such case the first printed circuit board 39 and the second printed circuit board 14 form rigid parts of the joint flexible circuit board whereby the first printed circuit board 39 and the second printed circuit board 14 are interconnected by a flexible circuit board part. The flexible circuit board part may be formed by polyimide material layer covered by a copper layer and SMB-flex solder mask. The copper layer of the flexible circuit board part may take over function of electrical connection of the first printed circuit board 39 and the second printed circuit board 14 whereby the polyimide material layer may take over function of mechanical connection.

An energy storage means 13 is depicted in FIG. 3 being accommodated in the second housing 3. The energy storage means 13 can be a battery, a rechargeable battery or accumulator. The energy storage means 13 may typically be a Li-ion or a NiMh battery. The energy storage means 13 can also include more than one unit for storing electric energy, for example two batteries in order to fulfill the voltage and/or power requirements of the emergency lighting device 1 and its electronic circuitry.

Of course, it is also possible to arrange parts of the electronic circuitry in the second housing. This is particularly advantageous for electronic circuitry which does not form part of a basic configuration of the emergency lighting means 1. Whereas the basic configuration of the emergency lighting means 1 can comprise all essential elements to fulfill the role as an emergency light, additional capabilities such as a digital electronic lighting interface (DALI™)

interface may be later added by exchanging the second housing 3 and possibly the interconnecting means 4 for adding electronic circuitry implementing those additional functions.

The energy storage means 13 in the second housing can easily be replaced by another energy storage means 13 when the original energy storage means 13 reaches the end of its life expectation or when for a specific application of the emergency lighting device 1 another electric storage capacity is required. By providing the capability of exchanging the entire second housing 3 with the elements contained therein, the basic configuration of the emergency lighting device 1 needs only to take account of the space requirements for implementing the basic functions, whereas the space requirements needed for presumed later additional functions can be satisfied by replacing the second housing 3. This provides for a versatile lighting device 1 at small dimensions but also having great potential for upgrades.

Figure 4:
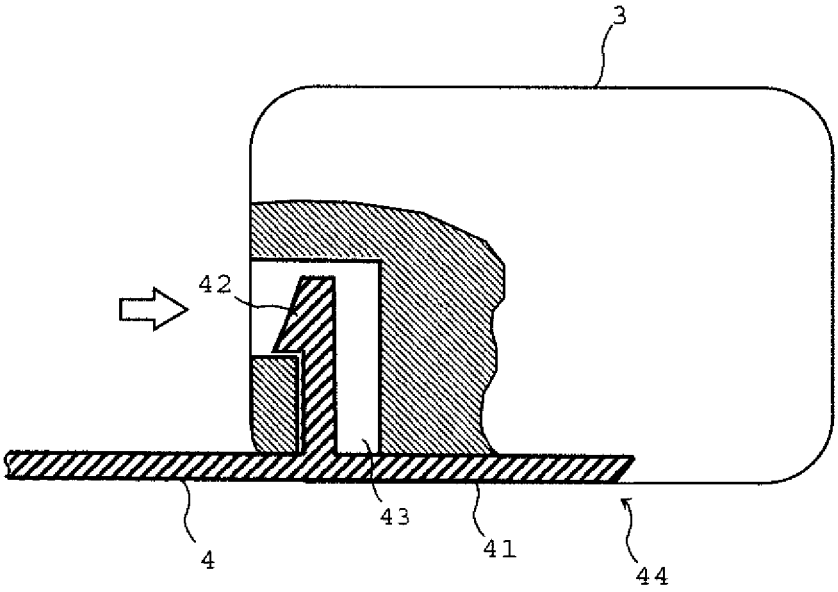

FIG. 4 presents a partial sectional view of a preferred embodiment showing attachment details of the interconnecting means 4. The interconnecting means 4 includes a first main portion 41. The first main portion 41 is attached to the first housing 2 and to the second housing 3 with the respective ends of the first main portion 41. Alternatively, the first main portion may be integrally formed with one of the two housings 2, 3. The interconnecting means 4 comprises further a second extended portion 42, which extends perpendicular from the first main portion 41. When attaching the interconnecting means 4 to the second housing 3, the second extended portion 42 interacts with a corresponding recess 43 of the second housing 3 to fix the interconnecting means 4 at the second housing 3 in addition to an attachment at an end 44 of the interconnecting means 4. The attachment at the end 44 of the main portion 41 of the interconnecting means 4 can be implemented by an end face of the main portion 41 interacting with a corresponding undercut at the second housing 3, as is exemplarily shown in FIG. 4. The second extended portion 42 and the recess 43 of the second housing 3 together implement a "snap-in"-connection which can be released by exerting a compressive force in direction of the arrow in FIG. 4 on a part of the second extended portion 42 accessible through an opening in the second housing 3. This snap-in connection depicted in FIG. 4 simultaneously acts like a fulcrum for the hinged interconnecting means 4. It is to be noted that the shown snap-in connection is only one of a plurality of possibilities to additionally fix the interconnecting means 4 to the second housing 3 at a further point of the interconnecting means 4 different from the end 44 of the interconnecting means 4 towards the interconnecting means 4.

Figure 5A:
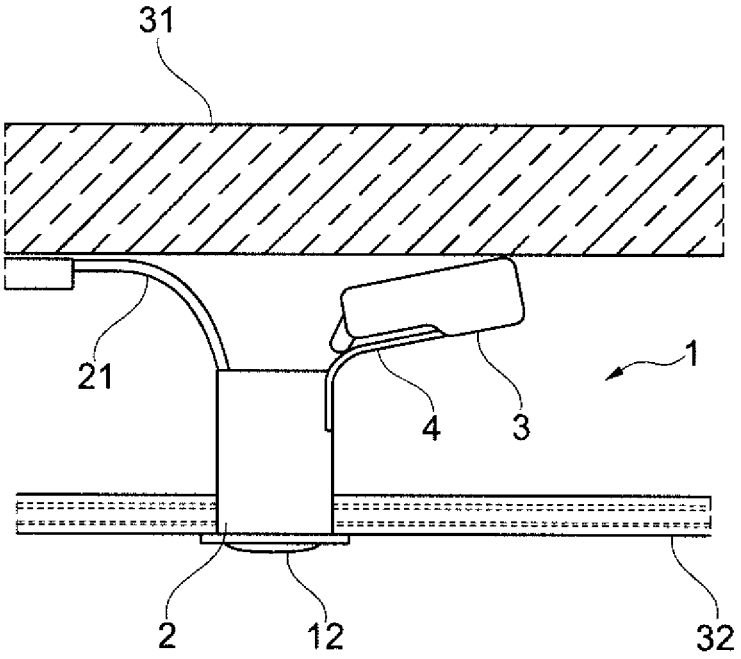
FIG. 5*a* shows an emergency lighting device of a preferred embodiment mounted in a detached ceiling.
Figure 5B:
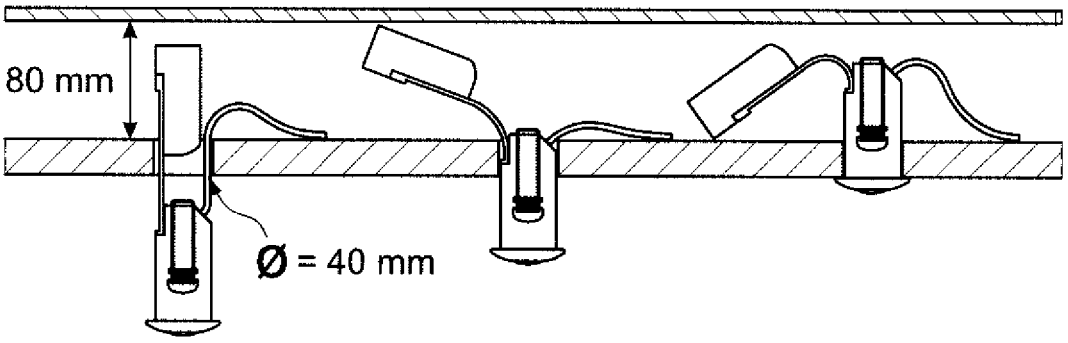
FIG. 5*b* shows from the left to the right the steps of inserting and mounting the emergency lighting device.

In FIGS. 5*a* and 5*b*, an emergency lighting device 1 as a recessed luminaire is shown in a mounted position in a detached ceiling 32. The detached ceiling 32 is arranged at a distance to and below a ceiling 31 shown as a concrete ceiling. The distance between the detached ceiling 31 and the ceiling 31 is often small and may be even only some centimeters. For sake of simplicity, any suspending units for holding the detached ceiling 32 are omitted in FIGS. 5*a* and 5*b*. In the limited space between the ceiling 31 and the detached ceiling 32 elements of the building infrastructure can be arranged. In FIG. 5*a* a mains supply line 21 is shown. The mains supply line 21 is a cable for connecting a luminaire to the mains supply of the building.

For mounting a recessed luminaire, a usually circular opening is established in the detached ceiling 32. In case of the emergency lighting device 1 according to an embodiment, the opening can be as small as having a diameter of about 40 mm. The invention is of course not limited to such diameter.

In order to mount the emergency lighting device 1, the mains supply line 21 is drawn out of the opening and connected with an electrical clamp to terminals of the first housing 2 of the emergency lighting device 1. Usually the first housing 2 provides some sort of strain relief for fixing the outer cable sheath of the main supply line 21 at the first housing 21. The electrical connection of the emergency lighting device 1 is now accomplished.

Contrary to prior art, only a single flexible mains supply cable 21 needs to be connected, while in prior art, regularly a number of further interconnecting cables between subunits of conventional emergency lighting device particularly suitable for confined spaces have to be connected.

The emergency lighting device 1 is now inserted into the hole beginning with the second housing 3. Advantageously, the second housing 3 has a smaller width than the first housing 2 in order to enable the mains supply cable 21 to also being inserted back through the hole into the space between the detached ceiling 32 and the ceiling 31. In the case depicted in FIG. 5*a*, an entire height of the emergency lighting device 1 is greater than an available distance between the detached ceiling 32 and the ceiling 31. Accordingly, a first end portion of the emergency lighting device 1 on the second housing towards the ceiling 31 touches to the ceiling 31 during insertion. Due to the elasticity of the interconnecting means 4, the second housing 3 can elude to the right as the preferred bending direction when continuing to push the emergency lighting device 1 through the hole upwards. Due to the elasticity of the interconnecting means 4, the second house 3 is almost entirely angled to the right side, when the emergency lighting device 1 is fully inserted into the hole in the detached ceiling 32. In the mounted position, the lighting means (LED head) 12 of the emergency lighting device 1 having a larger bezel diameter than the hole diameter and the diameter of the first housing 2 will be almost level with the lower surface of the detached ceiling 32, whereas the vast portion of the body of the emergency lighting device 1 is positioned in the space between the detached ceiling 32 and the ceiling 31. In an exemplary embodiment, the bezel diameter of the emergency lighting device 1 is about 50 mm and thus covers a hole with a diameter of 40 mm in the detached ceiling 32 entirely.

Embodiments of the emergency lighting device 1 according to the invention allow insertion through holes of 40 mm diameter to void depths as small as 80 mm (as shown as one example in FIG. 5*b*). The example of FIG. 5*b* shows from the left to the right the steps of inserting and mounting the emergency lighting device 1 as described above.

As shown in FIG. 5*b* there is on a side of the first housing 2 a fixing means 8 comprising a spring. The mounting of the fixing means 8 on the first housing 2 will be described later in detail. When the emergency lighting device 1 is inserted in detached ceiling 32 the fixing means 8 prevents a drop out of the emergency lighting device 1 and by the aid of the spring of the fixing means 8 it secures fixed mounting of the emergency lighting device 1 in the detached ceiling 32. A detailed example of the fixing means 8 will be described by FIG. 8.

In the example shown in FIG. 5*a*, the advantageous spatial separation of the mains supply line 21 and the interconnecting means 4 including the connecting cable between the electronic circuitry arranged in the first housing 2 and the energy storage means 3 in the second housing is also evident. Thus, coupling of undesired interference signals between the connection cable of the interconnecting device 4 and the mains supply line 21 is minimized, as those lines are clearly separated. In the prior art, additional care has to be exercised to clearly separate the different cables when inserting different cables into the space beyond the detached ceiling, a task even more difficult when taking a small hole of about 40 mm into account.

FIG. 5*a* also shows that the interconnecting means 4 according to the invention secures a minimum spatial distance between the first housing 2 and the second housing even in the mounted position in the generally inaccessible space between the detached ceiling 32 and the ceiling 31. The first housing 2 usually contains electronic circuitry, for example a converter circuit for driving LEDs and/or charging means for charging the energy storage means, which generates heat. The converter circuit for driving LEDs and/or charging means for charging are preferably formed by a high frequency clocked converter e.g. flyback, buck, boost, buck-boost or other switch mode power supply topology. The second housing 3 contains the temperature sensitive energy storage means, for example a rechargeable battery which reacts with reduced efficiency to a temperature increase. Accordingly the interconnecting means 4 of the emergency lighting device 1 provides a further advantage over the flexible cabling between an energy storage means and electronic circuitry for driving an LED known from prior art.

Figure 6:
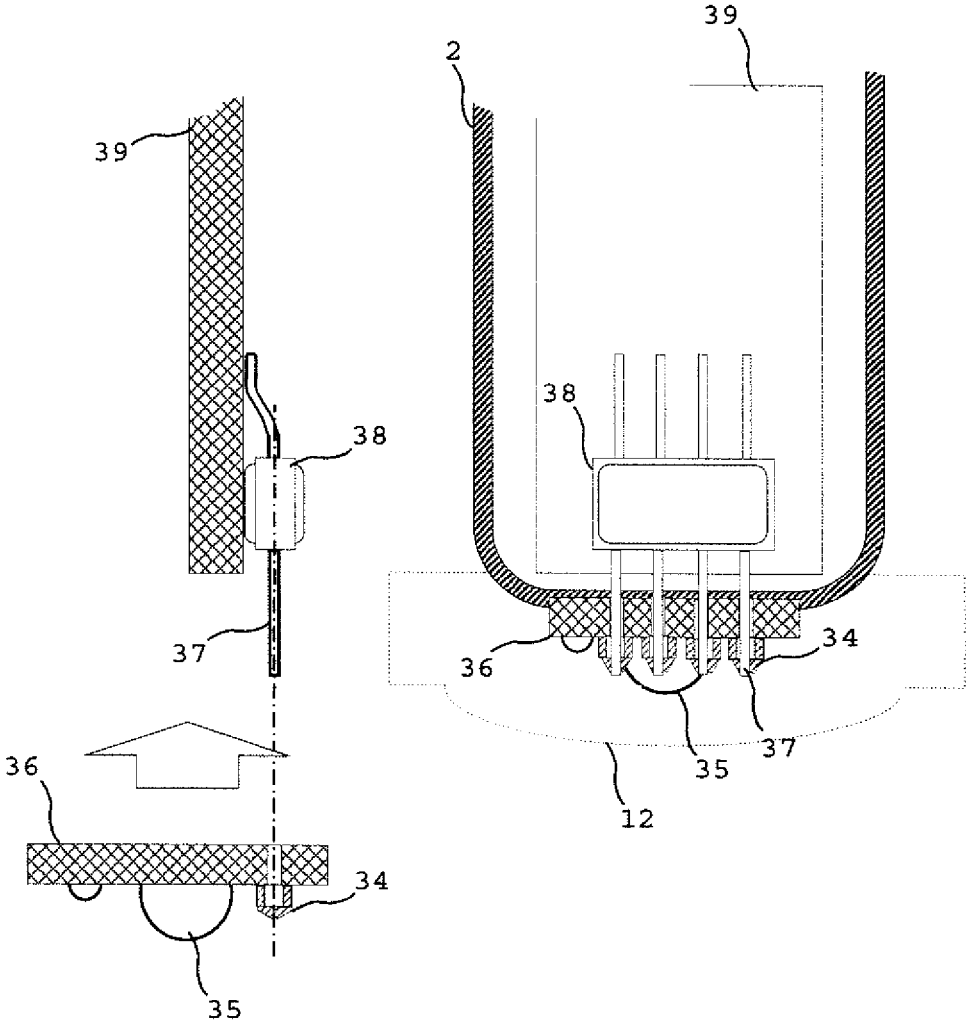
FIG. 6 shows a partial view of an emergency lighting device of an embodiment providing details of the attachment of a LED lighting means to the first housing.

In FIG. 6, in a partial view of an emergency lighting device 1 of a preferred embodiment, details of the attachment of a LED lighting means to the first housing 2 are shown. In the lower left, a printed circuit board 36 mounting single LED 35 as light emitting element is shown. A contacting element 34 can be seen mounted above a through hole in the printed circuit board 36. The whole assembly of the printed circuit board 36, contacting element 34 and possibly further circuit elements on the printed circuit board 36 forms a LED head which is detachably connected to a printed circuit board 39 arranged in the first housing 2. The printed circuit board 39 as shown in the upper left of FIG. 6 is one of the one or more printed circuit boards 14, 39 on which the electronic circuitry contained in the first housing 2 is shown. On the printed circuit board in particular driving means for driving the lighting means is arranged. The printed circuit board 39 also mounts a connector 38, for example a pluggable connector with solid connecting pins 37 extending beyond an edge of the printed circuit board 39. The connecting pins 38 together with the through hole in the printed circuit board 36 and the contacting element 34 on the printed circuit board 36 of the LED module form a pluggable and compact connecting system for electrically connecting the LED head with the electronic circuitry of the emergency lighting device 1 arranged in the first housing 2.

In the right half of FIG. 6, the LED head is depicted being attached to the printed circuit board 39 in the first housing 2 in a view rotated by 90 degrees when compared to the right half of FIG. 6. The dashed line 12 in FIG. 6 indicates an external contour of the LED head. The external contour 12 refers to a housing shielding the LED head and also including a lens assembly for guiding light emitted by the LED 35 for fulfilling the respective task of the emergency lighting device 1 whereby the lens may be interchangeable as described in the example of FIG. 7.

The lens assembly may be part of interchangeable optics which allow to employ the lighting device 1 as a an antipanic light (basic illumination over a given area), an escape route indicator (pointer implemented via directional light) or a spot light (focused beam towards the floor) without needing to change the driving means or the other peripheral circuitry belonging to the charging means or energy storage means. The interchangeable optics may include a suitable lens to realize a required light scheme and can be supplied as an option to a user of the emergency lighting device 1. Examples for interchangeable optics are shown in FIG. 7.

In FIG. 6, in a partial view of an emergency lighting device 1 exemplary details of the attachment of a LED lighting means to the first housing 2 and the printed circuit board 39 arranged in the first housing 2 are shown. The depicted electrical connection of an LED lighting means and the printed circuit board 39 by the solid connecting pins 37 of the connector 38 extending through the holes in the printed circuit board 36 of the LED module represents a possible solution for the electrical connection. However, additionally or alternatively the electrical connection may be performed by a flexible cable with connectors for electrically linking the printed circuit board 39 with the printed circuit board 36 of the LED module. The lighting device according to the invention provides significant advantages in view of the prior art. It is to be noted that the various features of the different embodiments discussed before for sake of clarity in a separate manner may be combined for the invention as defined by the attached claims.

Figure 7:
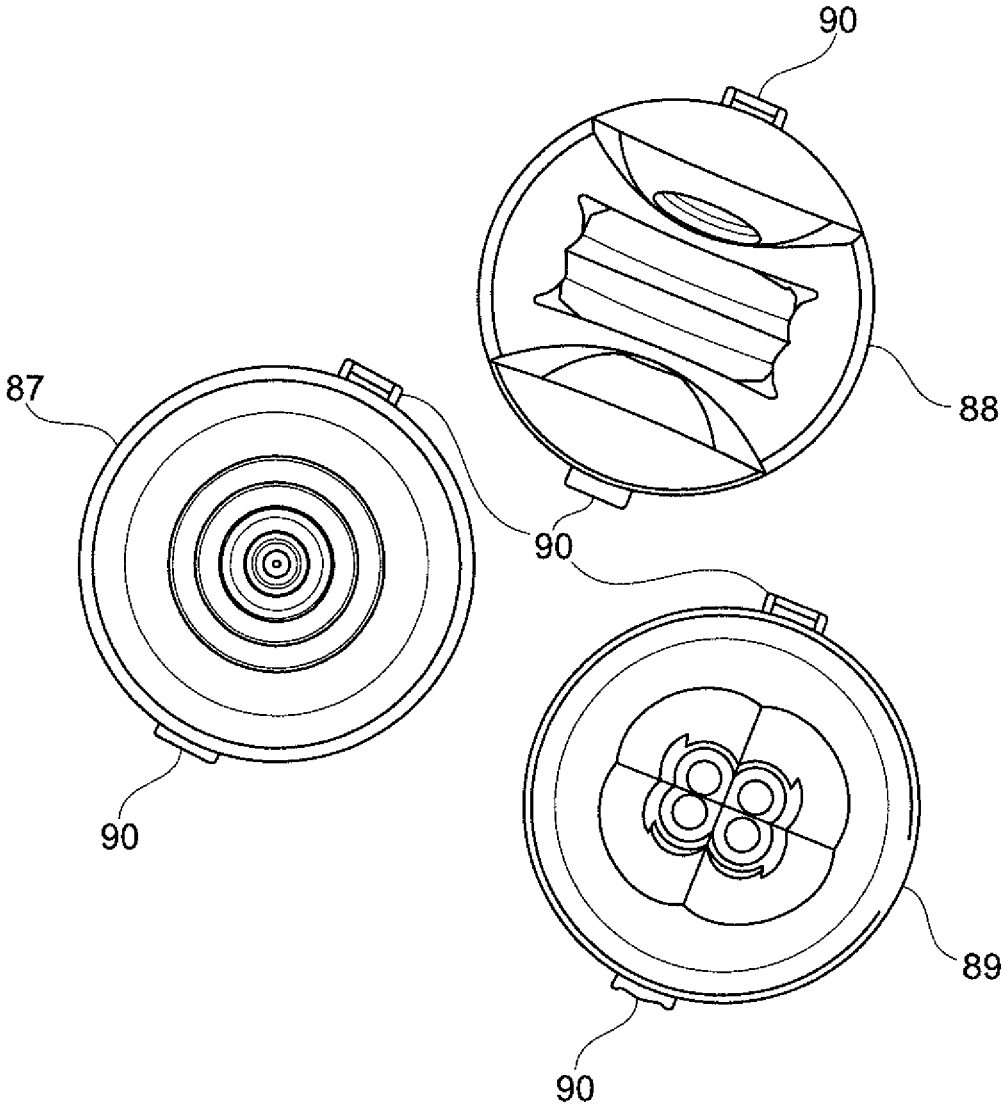
FIG. 7 shows different variants of the lens assembly.

FIG. 7 shows different variants of the lens assembly which may be part of interchangeable optics. For instance the lens 87 provides basic illumination over a given area and thus would allow to employ the lighting device 1 as an antipanic light. The lens 88 provides a pointer implemented via directional light and the lighting device 1 could be used as an escape route indicator. The lens 88 provides a focused beam towards the floor and the lighting device 1 could be used as spot light. The lens may be interchanged without need to change the driving means or the other peripheral circuitry belonging to the charging means or energy storage means. The lens as interchangeable optics may comprise barbed hooks 90 which secure releasable fixing of the lens on the lighting means 12.

Figure 8:
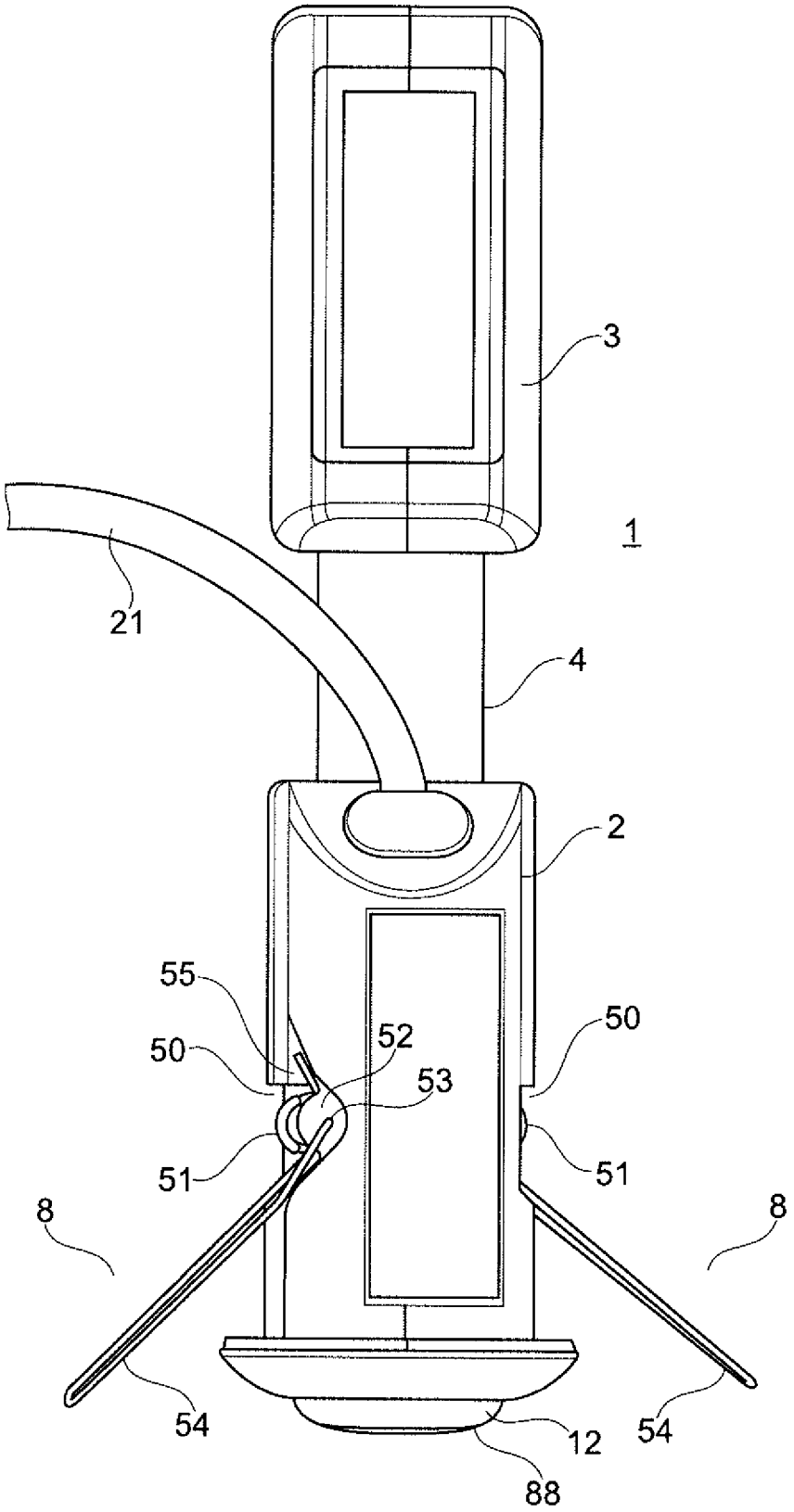
FIG. 8 shows a further view of the emergency lighting device.

FIG. 8 shows a further view of the emergency lighting device 1. The first housing 2 comprises the LED lighting means 12 equipped with one lens 88 and two fixing means 8 and two recess areas 50. As it can be seen the fixing means 8 comprises a spring with a spring coil 51 and a spring arm 54. The first housing 2 comprises advantageously at least two recess areas 50. The recess area 50 may comprise a protuberance 56 on one end and holding means 52 with a hole 53 on the other end. The spring coil 51 of fixing means 8 may be pushed into the recess area 50 and onto the protuberance 56 and thereby provide tension to the elongated end 55 of the spring coil 51 and thus the fixing means 8. The tail of the spring arm 54 of fixing means 8 may be then prepared for insertion through the hole 53 of the holding means 52. Preferably the tail of the spring arm 54 of fixing means 8 is inserted through the hole 53 of holding means 52 and the spring coil 51 thereby fixing the fixing means 8 to the first housing 2.

The elongated end 55 of the spring coil 51 is preferably extending in the opposite direction of the spring arm 54. When mounted onto the first housing 2 the elongated end of the spring coil 51 puts a force onto the recess area 50 and the spring arm will move into the direction away from the lighting means 12. When inserted into a detached ceiling 32 as in example of FIG. 5*b* the spring arm 54 will put force onto the detached ceiling 32 whereby the counter-force coming from the elongated end 55 of the spring coil 51 will secure fixing of the first housing 2 on the detached ceiling 32.

The invention claimed is:

1. An emergency lighting device comprising:

a first housing (2) adapted to be inserted into and mounted in an opening of a detached ceiling or wall panel;

lighting means (12) arranged at the first housing (2);

an electronic circuitry accommodated in the first housing (2) for operating the lighting means (12) and a mains supply cable (21) connected to terminals of the first housing (2); and a second housing (3) accommodating energy storage means (13), the first housing (2) and the second housing (3) being arranged spaced apart, by an elongated interconnecting means (4) adapted to connect the first housing (2) and the second housing (3) mechanically and to connect the electronic circuitry and the energy storage means (13) electrically, said elongated interconnecting means comprising a cable including two or more electrically connecting lines in an isolating mantle and further encapsulated by overmolding, said overmolding providing the elongated interconnecting means with compressive strength in an axial direction of the cable to maintain the second housing spaced from the first housing, wherein the overmolding does not bend because of the weight of the second housing and the energy storage means contained in the second housing, but does bend in a direction traverse to the cable when a bending force is applied during an installation of the emergency lighting device into the opening of the detached ceiling or wall panel.

2. The emergency lighting device according to claim 1 wherein the interconnecting means (4) has a cross section with a first width in a first direction being smaller than a second width in a second direction orthogonal to the first direction such that the over molding is predisposed to bend in a direction generally orthogonal to both the first direction and the second direction.

3. The emergency lighting device according to claim 1 wherein the interconnecting means (4) comprises a first straight portion (5), a second straight portion (6) and a pre-bended portion (7) between the first straight portion (5) and the second straight portion (6).

4. The emergency lighting device according to claim 1 wherein a guide protrudes from at least one of the first and second housing toward the other housing to prevent the interconnecting means (4) and the second housing (3) from bending in a given direction.

5. The emergency lighting device according to claim 1 wherein the interconnecting means (4) includes a first connector for electrically connecting the interconnecting means (4) to a printed circuit board (14) arranged in the first housing (2).

6. The emergency lighting device according to claim 1 wherein the electronic circuitry is arranged on a printed circuit board (14) and at least one further electric circuit board (39), and the printed circuit board (14) and the at least one further electric circuit board (39) are connected by a flexible cable.

7. The emergency lighting device according to claim 6 wherein the lighting means (12) is adapted to detachably connect via a connector (34) to at least one of the printed circuit board (14) and the at least one further printed circuit board (39).

8. The emergency lighting device according to claim 6 wherein the interconnecting means (4) comprises a second connector, for electrically connecting the interconnecting means (4) to the energy storage means (13).

9. The emergency lighting device according to claim 1 wherein the electronic circuitry comprises charging means for charging the energy storage device (13), and the charging means is adapted to detect a type of the energy storage means (13).

10. The emergency lighting device according to claim 1 wherein the second housing (3) includes a first end portion (9) opposite to a second end portion, the second end portion being located closer towards the first housing (2), and the first end portion being formed to achieve a bending direction of the interconnecting means (4).

11. The emergency lighting device according to claim 1 wherein a releasable snap-in connector connects the interconnecting means (4) to the second housing (3).

12. The emergency lighting device according to claim 1 wherein the electronic circuitry is arranged on a printed circuit board (14) and at least one further electric circuit board (39), and the printed circuit board (14) and the at least one further electric circuit board (39) are rigid parts of a joint flexible circuit board.

13. The emergency lighting device according to claim 1 wherein the lighting means (12) is designed to hold an interchangeable lens.

14. An emergency lighting device comprising:

a first housing (2) adapted to be inserted into and mounted in an opening in a detached ceiling or wall panel;

lighting means (12) arranged at the first housing (2);

an electronic circuitry accommodated in the first housing (2) for operating the lighting means (12); and a second housing (3) accommodating energy storage means (13), the first housing (2) and the second housing (3) being arranged spaced apart, by an interconnecting means (4) adapted to connect the first housing (2) and the second housing (3) pivotally and to connect the electronic circuitry and the energy storage means (13) electrically;

wherein the first housing (2) comprises at least two recess areas (50) and at least two fixing means (8), each comprising a spring coil (51) and a spring arm (54) whereby each said fixing means (8) is mounted in one of the respective recess areas (50).

15. The emergency lighting device according to claim 14 wherein the interconnecting means (4) comprises a hinge adapted to pivotally connect the first housing (2) and the second housing (3) provides one axis of rotation.

16. The emergency lighting device according to claim 14, wherein each said recess area (50) comprises a protuberance on one end and a spring mount with a hole (53) on the other end whereby the spring coil (51) is designed to be pushed into the recess area (50) and onto the protuberance and a tail of the spring arm (54) is designed for insertion through the hole (53).

* * * * *